US007878237B2

(12) United States Patent
Angman

(10) Patent No.: US 7,878,237 B2
(45) Date of Patent: Feb. 1, 2011

(54) ACTUATION SYSTEM FOR AN OILFIELD TUBULAR HANDLING SYSTEM

(75) Inventor: Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 601 days.

(21) Appl. No.: 11/858,048

(22) Filed: Sep. 19, 2007

(65) Prior Publication Data

US 2008/0053660 A1 Mar. 6, 2008

Related U.S. Application Data

(63) Continuation-in-part of application No. 10/599,076, filed as application No. PCT/CA2005/000570 on Mar. 18, 2005, now Pat. No. 7,694,730.

(60) Provisional application No. 60/521,252, filed on Mar. 19, 2004, provisional application No. 60/826,189, filed on Sep. 19, 2006.

(30) Foreign Application Priority Data

Sep. 25, 2006 (CA) ..... 2560828

(51) Int. Cl.
*E21B 33/05* (2006.01)

(52) U.S. Cl. ..... 166/70; 166/285; 166/373

(58) Field of Classification Search ..... 166/95.1, 166/373, 329, 70, 285, 177.4
See application file for complete search history.

(56) References Cited

U.S. PATENT DOCUMENTS 1,217,467 A 2/1917 Lincoln
2,755,742 A * 7/1956 Vincent ..... 417/320
3,063,080 A * 11/1962 Bergman et al. ..... 15/104.062
3,951,208 A 4/1976 Delano
4,491,177 A * 1/1985 Baugh ..... 166/75.15
5,833,002 A * 11/1998 Holcombe ..... 166/291
5,918,673 A * 7/1999 Hawkins et al. ..... 166/285
6,253,791 B1 * 7/2001 Miklo ..... 137/876
6,302,199 B1 * 10/2001 Hawkins et al. ..... 166/70
6,311,792 B1 11/2001 Scott et al.
6,742,584 B1 6/2004 Appleton
6,776,228 B2 * 8/2004 Pedersen et al. ..... 166/75.15
6,799,638 B2 10/2004 Butterfield, Jr.
6,959,766 B2 11/2005 Connell
7,325,610 B2 2/2008 Giroux et al.
7,510,007 B2 * 3/2009 Robichaux et al. ..... 166/291
7,571,773 B1 * 8/2009 West et al. ..... 166/373
7,624,810 B2 * 12/2009 Fould et al. ..... 166/387
2002/0062965 A1 * 5/2002 Allen ..... 166/368
2005/0039925 A1 2/2005 Connell
2006/0032638 A1 2/2006 Giroux et al.
2008/0190613 A1 * 8/2008 Tjorswaag et al. ..... 166/289

FOREIGN PATENT DOCUMENTS

WO WO 2005/090740 9/2005

* cited by examiner

*Primary Examiner*—Daniel P Stephenson
(74) *Attorney, Agent, or Firm*—Bracewell & Giuliani LLP

(57) ABSTRACT

An actuation system for a tubular handling mechanism of a tubular handling assembly has a mud flow path passing through rotating parts and non-rotating parts of the tubular handling assembly. A ball drop assembly has an opening to the mud flow path through which a ball is released. The ball drop assembly opening is positioned in a non-rotating part. A lateral passage joins the mud flow path downstream of where the ball is released. A valve is positioned in the mud flow path at the lateral passage for selectively directing a purge fluid from the mud flow path out the lateral passage.

25 Claims, 6 Drawing Sheets

ACTUATION SYSTEM FOR AN OILFIELD TUBULAR HANDLING SYSTEM

FIELD OF THE INVENTION

The present invention relates to an oilfield tool assembly and, in particular, to an actuation system for use during oilfield tubular string handling.

BACKGROUND OF THE INVENTION

During oilfield drilling and borehole completion operations tubular strings may be handled in the form of a drill string, a casing string or a liner string for drilling and/or lining the borehole, etc. To grip a tubular and the tubular string, a tubular gripping tool may be used. In some operations, such as casing drilling and/or casing running, tubular gripping tool in the form of a casing clamp may be used to grip the string at its upper end.

A tubular gripping tool may be connected for manipulation by a top drive or other device, the entire assembly being suspended in a rig or derrick by a draw works, if desired.

Tubular gripping tools may include gripping means that engage the tubular being handled. Gripping means may include, for example, devices that mechanically or frictionally engage the tubular including, for example, slips, jaws, packers, expandable members, etc., catch devices that hook under a shoulder on the tubular being handled, such as elevators, etc. and/or other members that exert a mechanical or physical force or field on the tubular to engage it. Tubular gripping tools may also include spears, which are intended to extend into the bore of a tubular being handled. An external gripping tool may include a center spear and gripping means that engage an outer surface of a tubular to be handled. In use, the spear is inserted into the inner diameter of the tubular and the gripping means grip the outer surface thereof. An inside gripping clamp may include a spear with gripping means thereon, such that when the spear extends into the bore of a tubular being handled, the gripping means are positioned for engagement of an inner wall of the bore of the tubular.

An example of an inside gripping clamp is described in U.S. Pat. No. 6,742,584 of Appleton, and assigned to the present assignee TESCO Corporation. An example of an external gripping clamp is described in U.S. Pat. No. 6,311,792 of Scott, which is also assigned to the present assignee.

A spear of a tubular gripping clamp may carry various tubular handling mechanisms. For example, a spear may include a seal thereabout which is selected to engage and create a seal against the inner diameter of the tubular being handled. During operation, drilling fluid, commonly called mud and which can be liquid or gas-based, is pumped down through the spear and the seal creates a seal against the inner diameter to maintain fluid pressure in the tubular string. The seal generally is passive and operates against a pressure differential.

In a well control incident, it may be desirable to shut in the well, including sealing the upper end of the tubular string. If such an incident occurs during the use of a gripping clamp, well control may be achieved by reliance on the seal about the clamp's spear. As a next step, or where a failure of the passive seal is encountered, it may be desirable to support the tubular string in the floor of the derrick/rig and to remove the casing clamp from the tubular, such that the tubular string can be capped. In a situation where both the draw works and the spear seal fail, the well may be very difficult to control. In such a situation, a blow out preventer may be useful for carriage on the spear.

In addition or alternatively, a spear may carry other tubular handling mechanisms including for example, launching systems, such as for plug launching or tool release apparatus.

For spear-carried tubular handling mechanisms, such as a well control system or a launching system, an actuation system may be required to control the operation of the system. Because the tubular handling mechanism is carried on the spear, it may be necessary that at least a portion of the actuation mechanism be carried on the spear. Because the spear is often a rotating part, actuation mechanisms for spear-carried tubular handling mechanisms can add to the complexity of tubular handling systems.

SUMMARY OF THE INVENTION

In accordance with one aspect of the present invention, there is provided a ball launching assembly comprising: a body having a bore therethrough with an inlet end and an outlet end, and having a lateral passage connected to the bore, and a ball launch housing with a ball holding area connected to the bore; a valve in the bore located adjacent to the lateral passage, the valve actuatable to an open position to allow flow from inlet end through the bore to the outlet end, and a position to divert flow from the inlet end through the bore to the lateral passage; and a ball releasably contained in the ball holding area.

In accordance with another broad aspect of the present invention, there is provided a ball launching assembly comprising: a body having a bore therethrough with an inlet and an outlet, and having a ball launch housing with a ball holding area connected to the bore; a valve in the bore located downstream of the ball launch housing, the valve actuatable to control flow from the inlet through the bore to the outlet; and a ball releasably contained in the ball holding area.

In accordance with another broad aspect of the present invention, there is provided a method of inserting a ball in a passage of an oilfield tubular handling system, the oilfield tubular handling system having a derrick, a draw works, a swivel/washpipe, a power drive system, a pipe gripping mechanism, an oilfield tubular string connected at one end to the pipe gripping mechanism, and a mudline connected between a fluid supply and the swivel/washpipe, the method comprising: retaining a ball within a ball holding area in a housing; sealingly connecting the housing in-line with the mudline upstream of the swivel/washpipe; flowing fluid through the oilfield tubular handling system, including a flowbore in the housing; and moving the ball from the ball holding area into the flowbore of the housing.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
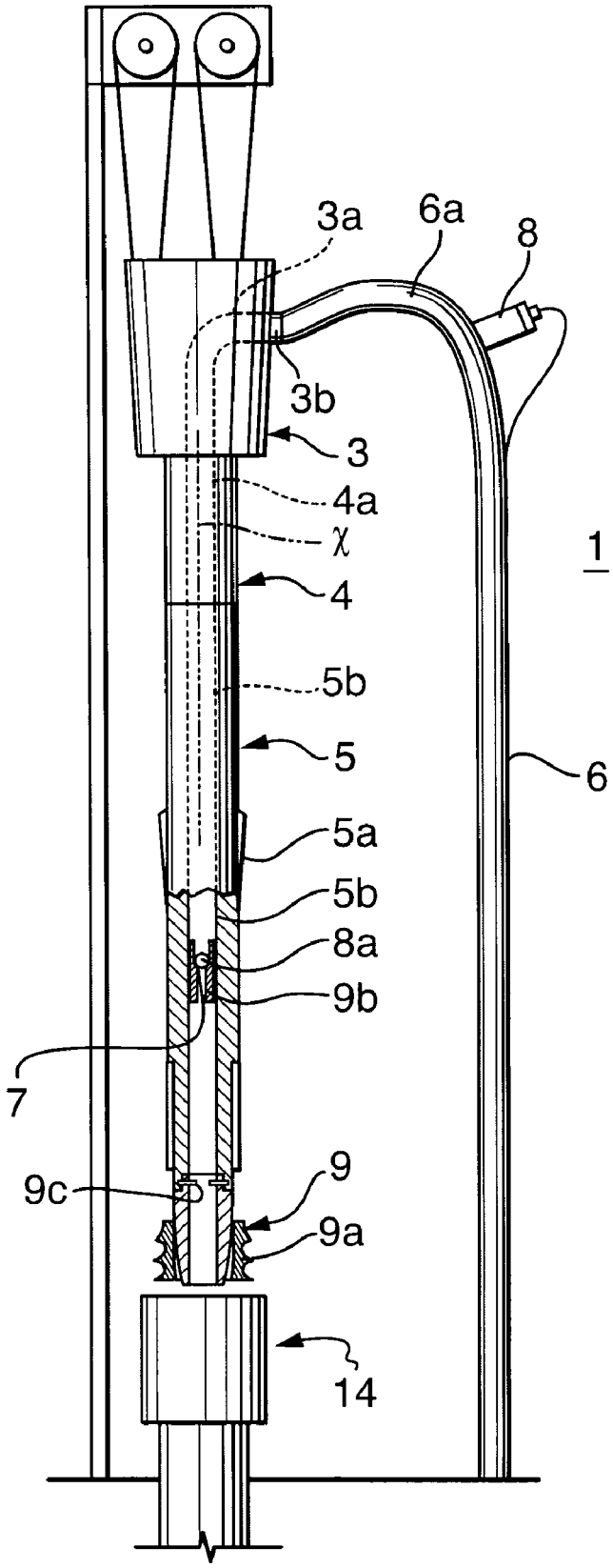
FIG. 1 is a schematic illustration of a hydraulic actuation system installed in a tubular handling assembly.

Referring to FIG. 1, an oilfield tubular handling system 1 is shown for manipulating tubulars and which includes an actuator system. The oilfield tubular handling system includes a vertically movable power drive assembly 3, a longitudinally extending output shaft 4, a pipe gripping mechanism 5, a mud line 6 and an actuation system including a valve seat 7 and a ball drop assembly 8.

The power drive assembly 3 is operable to provide rotary drive to various parts of the tubular handling system including longitudinally extending output shaft 4 and pipe gripping mechanism 5. In particular, output shaft 4 is rotatably turned about its longitudinal axis x by, and is movable vertically with, the power drive assembly. Pipe gripping mechanism 5 is coupled to and driven by the output shaft. The pipe gripping mechanism has a lower end 5*a* selected to grip and rotate an end of a tubular segment 14.

Mud line 6 is connected to a swivel 3*a* of the power drive assembly 3 and acts as a conduit for a mud flow to the power drive assembly. In particular, mud line 6 forms part of a mud flow path flowing from a supply, first through the mud line, then through a passage through the power drive assembly including through the swivel 3*a* and the main housing, through a passage 4*a* of the longitudinally extending output shaft and then through a passage 5*b* through pipe gripping mechanism 5.

An actuator system for actuating a tubular handling mechanism 9 is also provided. The actuator includes valve seat 7 positioned in the mud flow path useful to catch a ball 8*a* released from ball drop assembly 8 to create a high pressure condition upstream of the valve seat. The ball drop assembly is selected to release a ball to seat on the valve seat. To facilitate and simplify the handling, operation and construction of the tubular handling system, the ball drop assembly is positioned in a non-rotating portion of the tubular handling system. During operation, the power drive assembly will drive output shaft 4 and pipe gripping mechanism 5, which is secured to the output shaft, to rotate. Thus, at least a portion of the power drive assembly and the mud line will be non-rotating portions of the tubular handling system. As such, the ball drop assembly may be positioned to release ball 8*a* to the mud flow path upstream of passage 4*a* of output shaft 4. To avoid the complexity of the power drive assembly, it may be useful to install the ball drop assembly upstream of the power drive assembly swivel 3*b*. In the illustrated embodiment, ball drop assembly 8 is positioned in a flexible hose portion of the mud line, commonly known as the Kelly hose 6*a*. Seat 7 may be positioned anywhere along passages 3*a*, 4*a*, 5*b* or in a tool connected therebelow, but for actuation of many tubular handling mechanisms, will generally be positioned in passages 4*a* or 5*b*. As such, ball 8*a* is sized to pass through the ID of all of the mud lines 6, and through any necessary passages 3*a*, 4*a* and 5*b* to reach and land in seat 7.

As will be appreciated, ball 8*a* is the term used to describe an actual ball (i.e. a substantially spherical object), but may also refer to a dart, a plug or other device that can pass through the mud flow path to reach seat 7, but is selected, as by sizing and material selection, to be stopped by and sealed against the seat. It is to be understood that a ball drop assembly can operate in many different ways, for example, by various mechanisms that may not be adversely affected by normal drilling or tubular running operations and conditions, but may be actuated automatically or manually, directly or remotely when a ball is to be released. Assembly 9 may include a port to load one or more balls to a holding area and may include remotely or directly operated handles, gates or valves, remotely or directly actuated solenoids, etc.

Figure 5A:
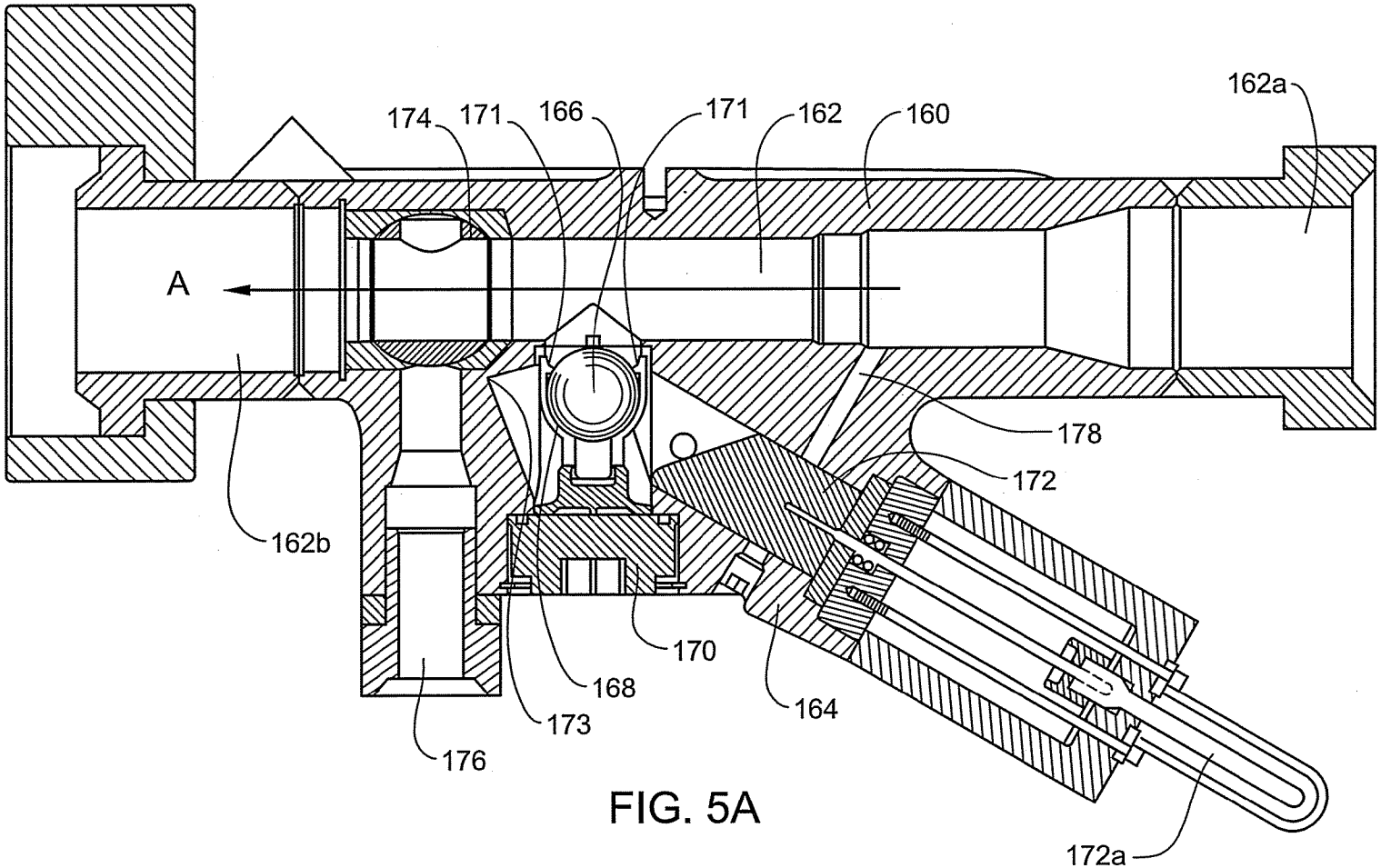
FIGS. 5A and 5B are axial sections through a ball launch assembly useful in the present invention.
Figure 5B:
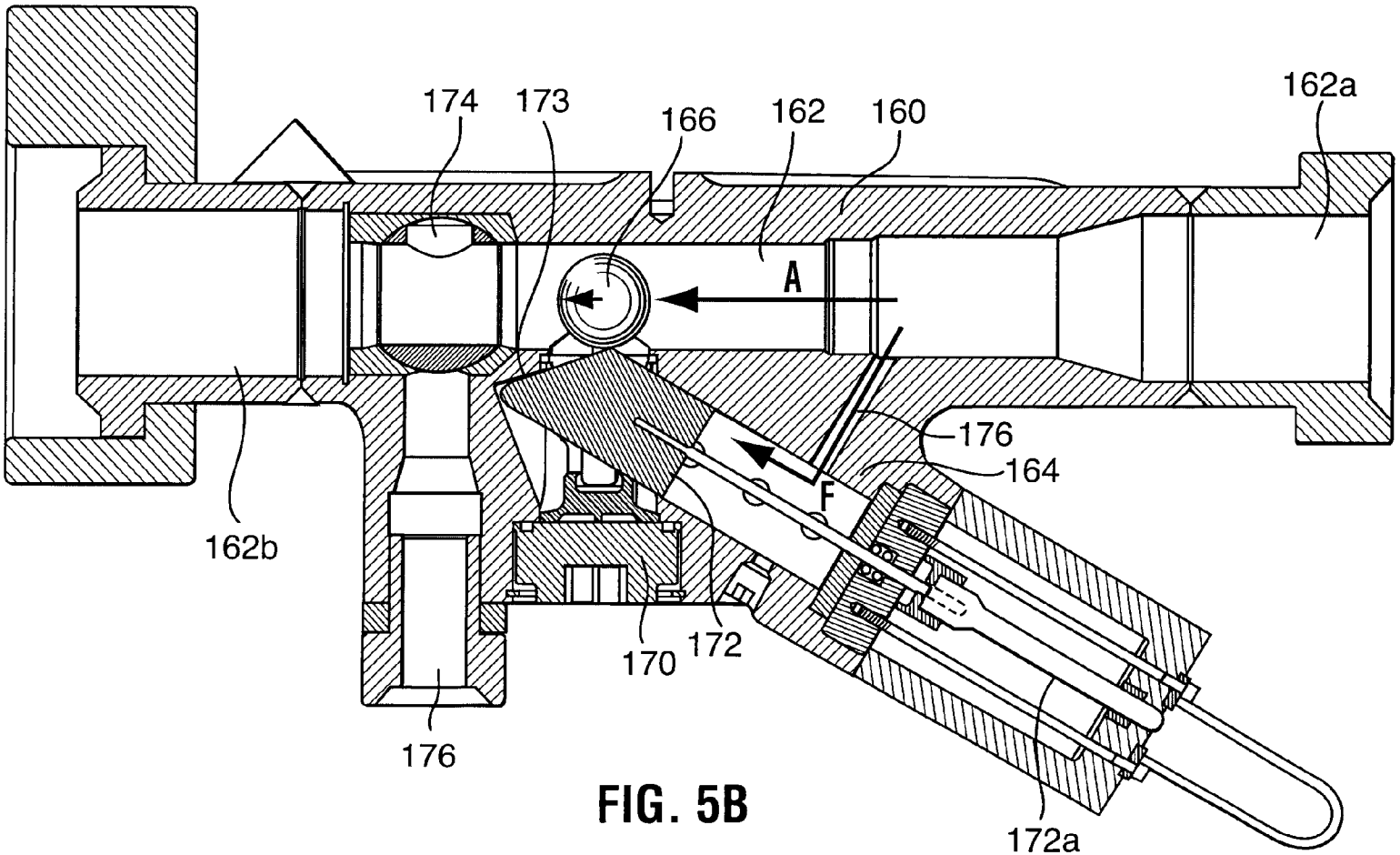

While various ball launch assemblies may be of use in the present invention, to facilitate understanding one useful ball launch assembly is illustrated in FIGS. 5*a* and 5*b*. In this illustrated embodiment, assembly includes a body 160 for positioning inline in a stand pipe or kelly hose. Body 160 includes a bore 162 therethrough for placement in communication with the mud flow path arrow A. Body 160 may include fittings, for example, at an inlet end 162*a* and an outlet end 162*b*, for connecting the body into a pipe or hose. The fittings may include threaded connections, quick lock fittings, clamps, etc. Body 160 includes a ball launching housing 164 sized to accommodate a ball 166 in a ball holding area 168. Ball launching housing 164 includes a closeable port 170 through which a ball can be loaded to the holding area. Ball holding area 168 is open to bore 162, but is configured, as by opening out laterally from the bore, to retain ball 166 out of the mud flow path through the bore. This permits unobstructed flow of fluids through bore 162 until it is desired that the ball be launched into bore 162 and, thereby, into mud flow path. Ball 166 may be retained in area 168 until it is desired to be released into the bore. In the illustrated embodiment, ball 166 is retained in the holding area by a biasing member such as collet fingers 171. Of course, other members may be used such as a spring loaded retainer pin, an openable gate, etc.

The ball may be injected into bore 162 by a launch mechanism including a plunger 172. Plunger 172 is drivable by a drive mechanism 172*a* to push the ball into the bore, for example, against the spring bias of the collet fingers, out of engagement by fingers and into bore 162. The plunger may include a ramped, wedge-shaped end that can moved behind the ball, through the collet fingers and push the ball from behind through the fingers. The housing may include a stop wall 173 to limit advancement of the plunger.

The ball launch assembly of the presently illustrated embodiment also includes a purge and flush mechanism to facilitate injection and operation of the assembly. In particular, the ball launch assembly includes side access to the bore through a lateral passage 176. Lateral passage 176 may include a fitting at its end for connection to a fluid line. A valve 174, such as a three way ball or barrel valve may be provided to control fluid flow through passage 176 to communicate with only one of inlet 162*a* or outlet 162*b*. Valve 174 may include an axial main throughbore and a lateral bore in communication with the main throughbore. The lateral bore may include an obstruction to deter any ball passing through the main throughbore from lodging in the lateral bore. While valve 174 is normally open to permit flow from inlet end 162*a* to outlet end 162*b* of the bore, the valve may be actuated to open inlet end 162*a* to passage 176 to permit a purge flow through bore 162, valve 174 and passage 176 to clear the bore of fluids, such as cement, that may adversely affect injection of ball 166. Passage 176 may also be used to introduce fluids to initiate the flow of a second fluid behind the ball after it is released. For example, the valve may be actuated to open communication between passage 176, valve 174 and bore 162 to permit a flow from the passage to the outlet end. If desired, a valve may also be actuatable to a closed position to stop flow through the bore.

The illustrated ball launch assembly also includes a flushing feature including a flushing channel 178 between bore 162 and the rear of ball holding area 168, through which a flushing fluid flow, arrow F, may be passed to clean area 168. Flow through channel 178 may be normally blocked by plunger 172 but may be opened by advancement of the plunger.

The drive mechanism and the valve may be in actuated various ways including manually, automatically, hydraulically, pneumatically and/or electronically.

The ball drop assembly and the ball seat may be part of an actuation system for an oilfield tubular handling mechanism 9. The oilfield tubular handling mechanism may take various forms and serve various functions. In one embodiment, for example, the actuation system may serve to release a component to the tubular string during tubular handling. The component may be released to actuate a downhole tool, to create an effect downhole or for various other purposes. For example, the tubular handling mechanism may release a component such as, for example, a plug, a cement float, a drop bar, ball, dart, etc. that actuates a downhole tool, or a component that is no longer of use. The tubular handling mechanism may be in the top drive, the pipe gripping device or somewhere along the tubular string. In one embodiment for example, the tubular handling mechanism may cause a component to be released from the gripping device into a tubular being handled. In another embodiment, the oilfield tubular handling mechanism may include a hydraulically operated component such as a seal, a valve actuator, a tool release, etc.

The actuating system may operate as by use of any of: a pressure communicating port, a piston, a sliding sleeve, a valve, shear pins, etc.

In the illustrated embodiment, for example, tubular handling mechanism 9 includes a part 9*a* intended to be released from lower end 5*a* of the pipe gripping mechanism. In the illustrated embodiment, tubular handling mechanism 9 includes a sliding sleeve 9*b* on which seat 7 is positioned. Sleeve 9*b* may be conveyed through passage 5*b* by a high pressure condition, as is caused by ball 8 landing in seat 7, to break shear pins 9*c*, positioned to hold part 9*a*, such that the part is released from the pipe gripping mechanism and can pass down into the tubular. In the illustrated embodiment, part 9*a* is a cementing plug, such as wiper plug useful in a wellbore cementing operation.

Figure 2:
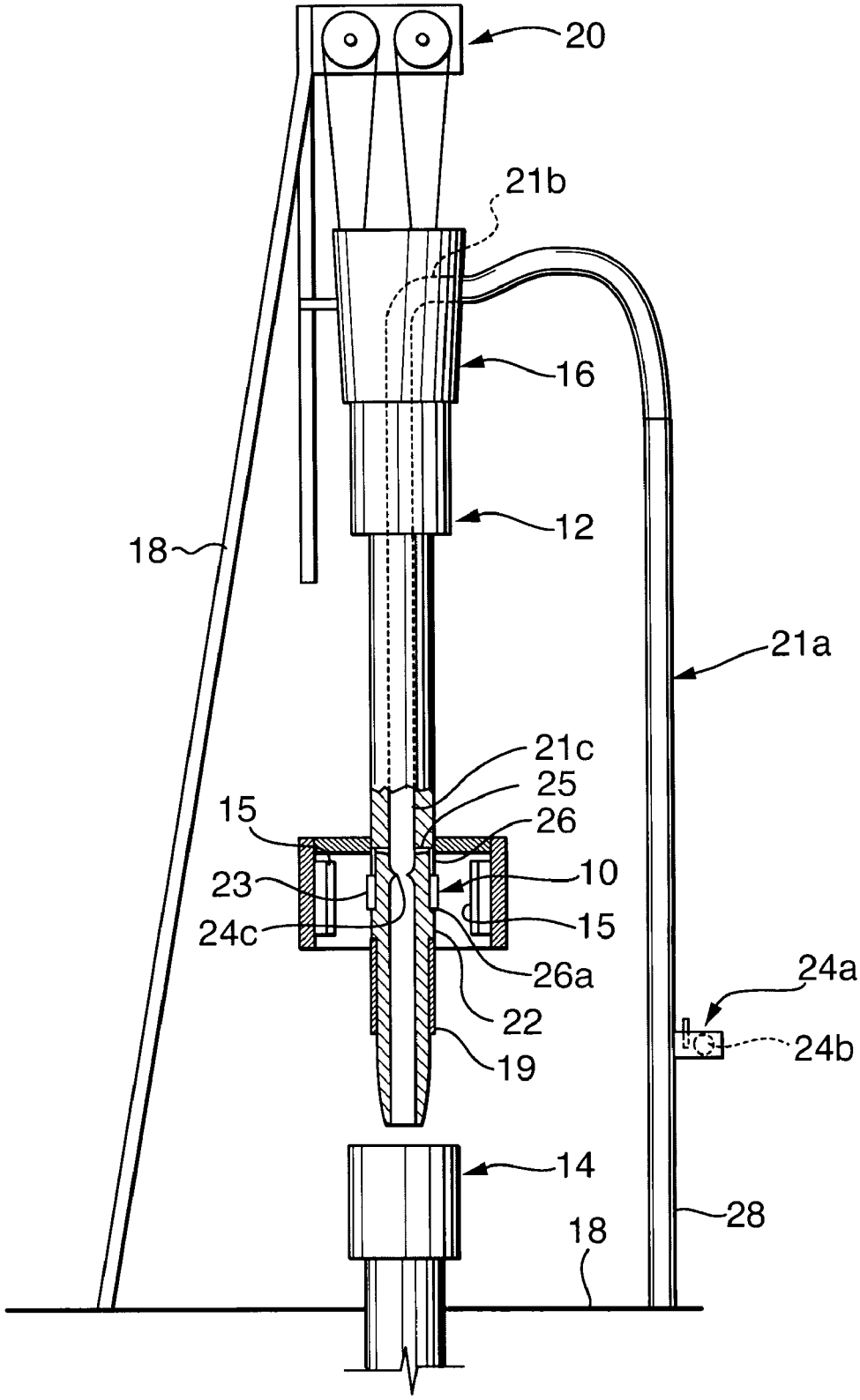
FIG. 2 is a schematic illustration of a blow out preventer assembly on an installed tubular gripping tool and including a hydraulic actuation system.

Referring to FIG. 2, a tubular handling system is shown including a tubular handling mechanism in the form of a blow out preventer assembly 10 for operating between a spear 22 of a tubular gripping tool, such as a casing clamp 12 of the external gripping type, as shown, or internal gripping type (FIG. 3), and a tubular 14 capable of being gripped by gripping slips 15 on the clamp 12. Clamp 12 may be connected for manipulation by a power drive assembly, such as for example, a top drive 16 or other device. The entire assembly of top drive 16 and clamp 12 may be suspended in a rig or derrick 18 by a draw works 20.

A mud flow path may be defined by mud lines 21*a*, including a standpipe 28 and a Kelly hose, on the rig extending between a mud supply and the assembly suspended on the draw works, that assembly including a passage through the top drive 21*b* including through the swivel/washpipe, the drive system gears, quill, etc. and a passage formed by an axial bore 21*c* through the clamp that opens at an end of a clamp spear 22 disposed in the tubular, when a tubular is gripped. The mudflow path provides that fluid, such as drilling fluid, can be pumped from a supply into the tubular. A passive seal 19 may be mounted about the spear to act against fluids migrating up between the spear and the tubular during normal operations.

In a well control incident such as a well kick or other pressure surge from the formation, it may be desirable to shut in the well, including sealing the upper end of the tubular string. If such an incident occurs during the use of an inside gripping clamp and the passive seal about the clamp and the draw works fails, the blow out preventer assembly 10 can be operated to create a seal between the clamp and the tubular inner wall, to in effect seal the upper end of the tubular string.

The blow out preventer assembly may include an expandable seal 23 carried on the tubular gripping tool, the seal being expandable to seal between the tool and the tubular's inner wall. Seal 23 is not normally driven out into engagement with the inner wall of the tubular, but only when it is necessary to contain a surge from the formation. The seal may be selectively expandable, for example, by a hydraulic drive. A hydraulic drive may be provided, for example, by means of a system according to the present invention.

In the embodiment of FIG. 2, for example, expandable seal 23 may be mounted between a piston 26 and a retainer 26*a* and can be driven by applying hydraulic pressure against piston 26 such that it is driven against the seal to cause it to extrude outwardly. The actuator system for driving the piston may include a ball drop mechanism 24*a* including a ball 24*b* that is sized to pass from mechanism 24*a* through the mud flow path to a ball valve seat 24*c* to cause a seal in bore 21*c* through the clamp. Seat 24*c* is positioned in bore 21*c* downstream of a port 25 communicating hydraulic pressure to actuating piston 26. In this position, a ball launched to seal against the seat can be used to increase the fluid pressure against piston 26 to drive it against seal 23.

Ball drop mechanism 24*a* is positioned upstream of any rotating parts including the clamp and portions of the top drive. Ball drop mechanism 24*a* is also positioned in a substantially stationary portion of the mud flow path, for example in a component that does not move with the action of the draw works. This positioning may be useful as access to the ball drop mechanism is not adversely affected by movement of the top drive and the top drive vertical or rotational movement need not be stopped or slowed to permit access. For example, in the illustrated embodiment, the ball drop mechanism is positioned in standpipe 28 adjacent the rig floor, which facilitates access thereto. In particular, in the standpipe, ball drop mechanism 24*a* may be positioned within reach of a person on the rig floor 18*a* (i.e. less than 9 feet above the floor) so that it can easily be accessed for manipulation such as loading, launching, maintenance, etc. In this position, the ball drop mechanism may additionally not be affected by vertical or rotational movement of the tubular handling assembly.

The ball 24*b* is sized to pass through the ID of all of the mud flow lines 21*a*, through the top drive passage 21*b* and through axial bore 21*c* of the clamp spear to reach seat 24*c*.

As will be appreciated, ball 24*b* may be a ball, a dart, a plug or other device that can pass through the mud flow path, but is selected, as by sizing and material selection, to be stopped by and sealed against the seat. A ball drop mechanism can operate in many different ways, for example, by various mechanisms that may not be adversely affected by normal drilling or tubular running operations and conditions, but may be actuated automatically or manually, directly or remotely when a ball is to be released. Mechanisms may include, remotely or directly operated handles, gates or valves, remotely or directly actuated solenoids, etc.

Thus, the embodiment of FIG. 2 provides a method for shutting in a well during use of a tubular gripping tool and when it remains with its spear positioned in the upper end of a tubular string extending into the well, which may occur during a well incident and when the passive seal of the clamp fails and the draw works cannot be operated to remove the clamp from the end of the tubing string. The method can include expanding a clamp spear expandable seal, such as seal 23, which is positioned about a spear for example spear 22 of the tubular gripping tool to create a seal between the spear and the inner diameter of the tubular string, thereby to seal the upper end of the tubular string.

The expandable seal may be expanded by a drive system that can be actuated selectively when it is desired to expand the seal. Various drive mechanisms may be useful, such as an arrangement that uses drilling mud to drive expansion, as in FIG. 2, or a system using another form of hydraulic pressure.

It may be useful to test the operation of the seal, since it may only be used occasionally, but when used may be of great importance. In a test, for example, it may be useful to conduct a flow test wherein a ball 24*b* is pumped from its release point to ensure that it can pass to seat without being obstructed.

Figure 3:
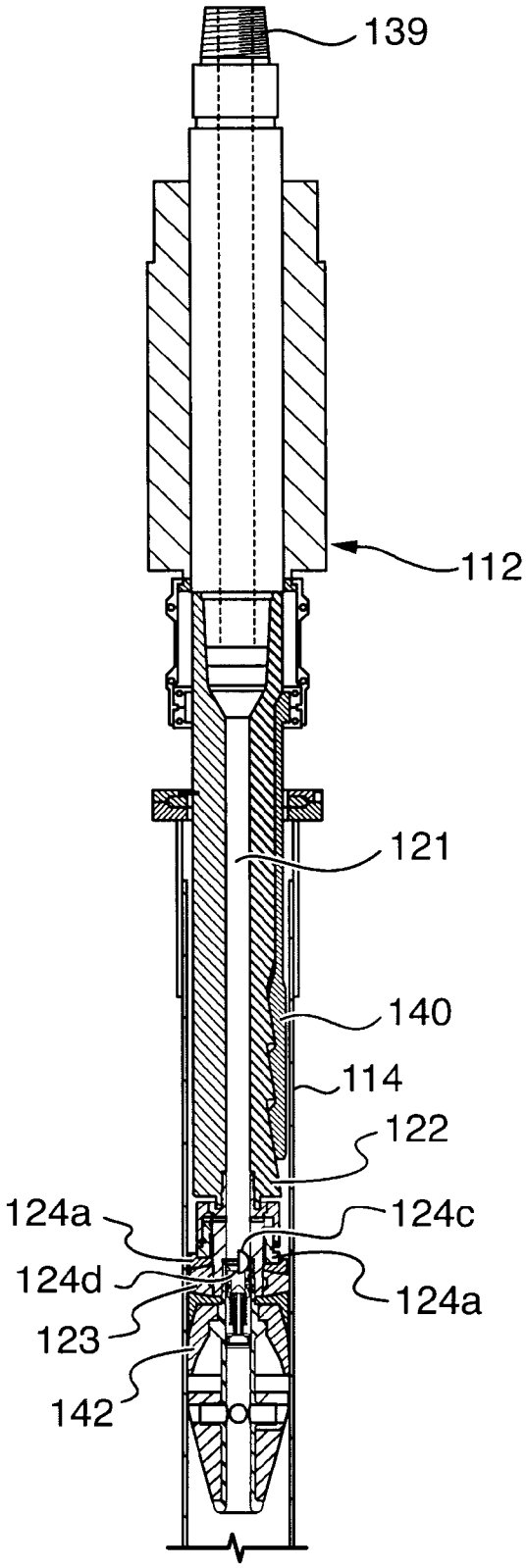
FIG. 3 is an axial section along a tubular gripping tool including a primary seal and a backup expandable seal, with the left hand side showing the backup seal in a non-expanded condition and the right hand side showing the backup seal in an expanded condition.
Figure 4:
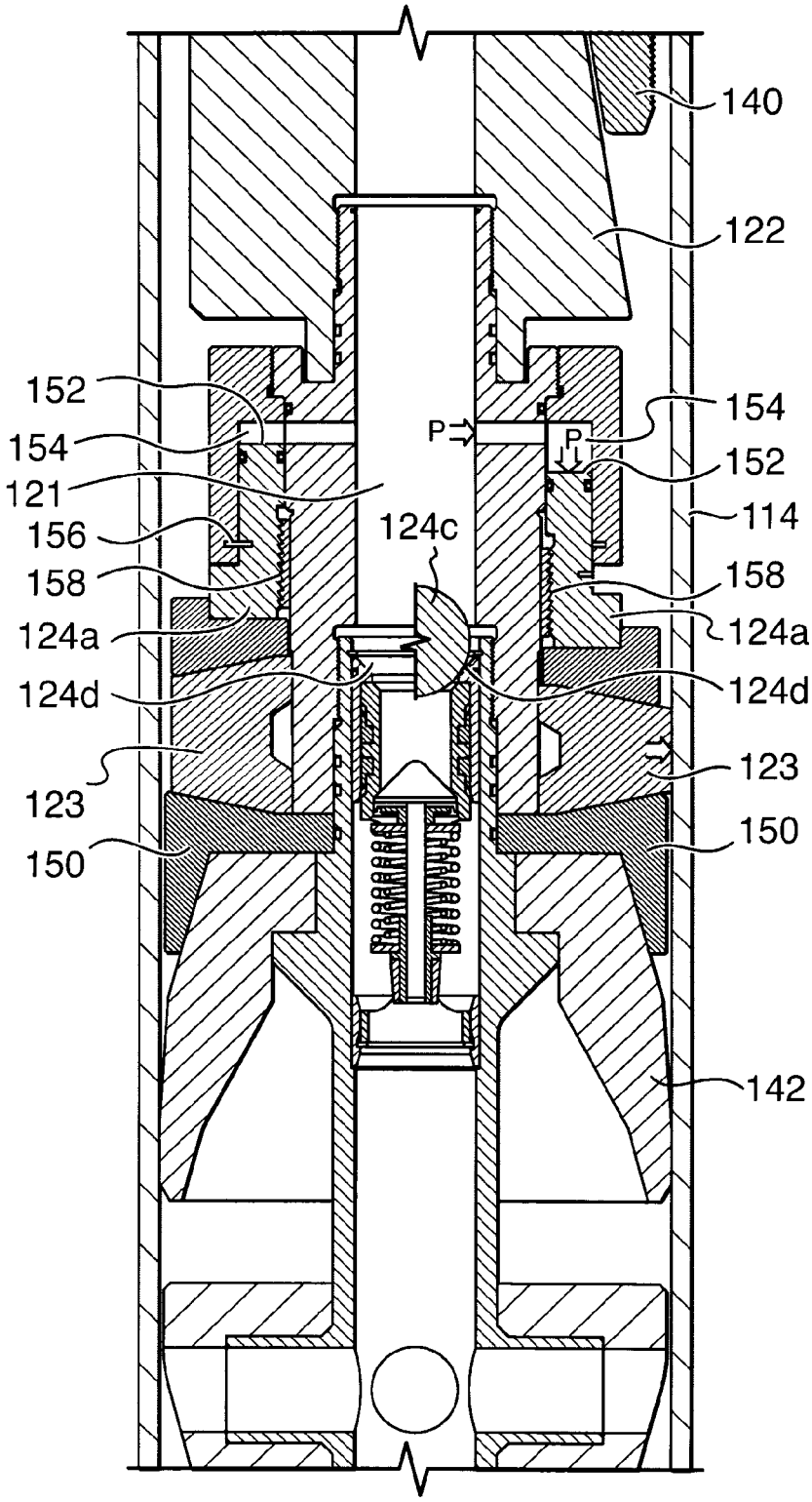
FIG. 4 is an axial section along a portion of a tubular gripping tool including a primary seal and a backup expandable seal, with the left hand side showing the backup seal in a non-expanded condition and the right hand side showing the backup seal in an expanded condition.

With reference to FIG. 3, another tubular handling system is shown including tubular handling mechanism in the form of a blow out preventer assembly. In FIG. 3, the blow out preventer is installed on an inside gripping clamp 112. Clamp 112 may be used for gripping an oilfield tubular 114 and may include an end 139 formed for connection to a top drive or other means for manipulating and/or suspending the clamp in a rig. Clamp 112 may include a spear 122 sized to extend into the bore of the tubular to be gripped, gripping slips 140, or other gripping means, positioned on the spear and drivable to engage the tubular to be gripped, a bore 121 through the clamp and its spear through which drilling fluid can pass into the tubular and a primary seal 142 about the spear to create a seal between the spear the inner wall of the tubular. Primary seal 142 may be expandable in response to an at least operationally generated fluid pressure differential in the tubular. Clamp 112 may further include a secondary seal 123 about the spear which is selectively operable to create a seal between the spear the inner wall of the tubular and, therefore, may be operated as a blow out preventer as a back up to primary seal 142. An enlarged view of the portion of the clamp about the primary and secondary seals is shown in FIG. 4.

As will be appreciated, clamp 112 may include any or all of the various additional parts shown in the illustrated embodiment such as a stabbing guide, a mud saver valve, a tubular stop flange, etc. Slips 140 and the drive system for the slips may take various forms, including those forms illustrated.

In normal operation of clamp 112, spear 122 is inserted into a tubular bore to grip the tubular during connection to or break out from a tubular string. When spear 122 is inserted into a tubular, primary seal 142 may seal against the inner wall of the tubular to contain drilling fluids in the tubular. In this normal operation, secondary seal 123 is maintained in a non-expanded condition such that it remains spaced from or not actively sealed against the tubular inner wall. This is shown in the left hand quarter sections of FIGS. 3 and 4.

Should a back up for primary seal 142 be necessary, seal 123 can be expanded to seal against the tubular inner wall.

Although many drive systems are possible, the drive system illustrated in FIGS. 3 and 4, acts by release of a ball 124*c* from a ball drop mechanism positioned in a non-rotating part of the top drive or mud lines somewhere upstream of a seat 124*d* in bore 121. Ball 124*c* may be pumped with the drilling mudflow into the clamp to seal against seat 124*b* so that mud pressure can be used to inflate the seal.

Seal 123, as in the illustrated embodiment, may be an extrudable ring packer mounted between a fixed retainer ring 150 and a piston ring 124*a*, shown as a two-part arrangement including a piston face 152. Piston face 152 may be open in a hydraulic chamber 154 in fluid communication with bore 121. Piston ring 124*a* may be secured in position by one or more shear pins 156. Shear pins 156 may be selected to prevent movement of piston 124*a* under normal pressures but to permit movement when fluid pressures in excess of a selected rating are applied against face 152. An example of normal operational pressure where the packer would not be activated is 3,000 psi. In this case the shear pins may be set to actuate at 3,500 to 3,750 psi. A ratchet arrangement 158 may be disposed between spear 122 and piston ring 124*a* to lock the piston into its pressure driven, energized position.

As noted, pressures sufficient to shear pins 156 may be applied by landing a ball 124*c* against seat 124*d* such that pressure can be increased above the ball. This increased pressure may be communicated, arrows P, to chamber 154 and against face 152. Induced movement of piston 124*a* causes seal 123 to extrude out, arrow E, between the piston and retainer 150.

The various parts of the tubular handling system and actuator system may be made of materials, and with methods, conducive to use in the oilfield industry, as will be appreciated.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A ball launching assembly comprising:

a body having a bore therethrough with an inlet end and an outlet end, and having a lateral passage connected to the bore, and a ball launch housing with a ball holding area connected to the bore;

a valve in the bore located adjacent to the lateral passage, the valve actuatable to a first position to allow flow from the inlet end through the bore to the outlet end and block flow through the lateral passage, and the valve having a second position to allow flow from the inlet end through the bore out the lateral passage and block flow from the inlet end to the outlet end; and a ball releasably contained in the ball holding area.

2. The assembly according to claim 1, wherein the ball is selected from a plug or a dart.

3. The assembly according to claim 1, further comprising:

a ball release mechanism having a plunger and a drive mechanism for pushing the ball into the bore.

4. The assembly according to claim 3, wherein the drive mechanism is manually actuated.

5. The assembly according to claim 3, further comprising:

a spring-loaded retainer to selectively retain the ball in the ball holding area, the retainer being located between the bore and the ball holding area in contact with the ball.

6. The assembly according to claim 5, wherein the retainer comprises a plurality of collet fingers.

7. The assembly according to claim 1, further comprising:

a ball retainer having a spring-loaded retainer to selectively retain the ball in the holding area.

8. The assembly according to claim 1, further comprising:

a ball retainer having a biasing member to selectively retain the ball in the ball holding area; and a ball release mechanism in the ball launch housing having a plunger and drive mechanism for overcoming the biasing member and pushing the ball into the bore.

9. The assembly according to claim 1, wherein the assembly is connected in-line with a mudline at a point upstream of a swivel.

10. The assembly according to claim 1, wherein the valve has a third position that allows flow from the lateral passage into the bore and out the outlet end and blocks flow from the inlet end to the outlet end.

11. The assembly according to claim 1, further comprising:

a ball release mechanism having a plunger and a drive mechanism for pushing the ball into the bore; and the plunger being carried within a plunger passage that extends downward and inward into an intersection with the ball holding area.

12. The assembly according to claim 11, further comprising:

a flushing channel extending from the bore to the plunger passage.

13. The assembly according to claim 11, wherein the plunger is reciprocable between upper and lower positions, and where the assembly further comprises:

a flushing channel extending from the bore to the plunger passage, the flushing channel being blocked by the plunger from flowing flushing fluid to the ball holding area while the plunger is in the upper position, and open to flow flushing fluid to the ball holding area while the plunger is in the lower position.

14. The assembly according to claim 11, wherein the plunger has a lower end that is inclined relative to an axis of the plunger passage.

15. The assembly according to claim 1, wherein the ball holding area is positioned between the valve and the inlet end of the bore.

16. The assembly according to claim 1, wherein the ball holding area comprises a port extending through a side wall of the body.

17. A ball launching assembly comprising:

a body having a bore therethrough with an inlet and an outlet, and having a ball launch housing with a ball holding area connected to the bore;

a valve in the bore located downstream of the ball launch housing, the valve actuatable to control flow from the inlet through the bore to the outlet;

a ball releasably contained in the ball holding area;

a all release mechanism having a plunger and a drive mechanism for pushing the ball from the ball holding area into the bore;

the plunger being carried within a plunger passage that extends downward and inward into an intersection with the ball holding area; and a spring-loaded retainer to selectively retain the ball in the holding area, the retainer being located between the bore and the ball holding area for releasably contacting the ball.

18. The assembly according to claim 17, wherein the body has a lateral passage and the valve is additionally actuatable to a position to divert flow from the inlet through the bore into the lateral passage.

19. The assembly according to claim 18, wherein:

the valve has a position that allows flow from the lateral passage into the bore and out the outlet and blocks flow from the inlet to the outlet.

20. The assembly according to claim 18, wherein:

the spring-loaded retainer comprises a set of collet fingers.

21. The assembly according to claim 17, wherein the ball is selected from a dart or a plug.

22. A method of inserting a ball in a passage of an oilfield tubular handling system, the oilfield tubular handling system having a swivel/washpipe, an oilfield tubular string connected below the swivel/washpipe, and a mudline connected between a fluid supply and the swivel/washpipe, the method comprising:

(a) retaining a ball within a ball holding area in a housing with a spring-biased retainer;

(b) sealingly connecting the housing in-line with the mudline upstream of the swivel;

(c) flowing fluid through the mudline, a flowbore in the housing, and the tubular string;

(d) advancing a plunger into the ball holding area, overcoming the spring-biased retainer and pushing the ball from the ball holding area into the flowbore of the housing and into the tubular string; and (e) landing the ball in a seat of a tool mounted in the tubular string.

23. The method of claim 22, further comprising the steps of:

providing a lateral passage through a side wall of the housing from the flowbore downstream of the ball holding area;

mounting a valve in the flowbore of the housing adjacent the lateral passage; and purging the flowbore by placing the valve in a position that directs flow down the flowbore into the lateral passage and blocks flow into the tubular string.

24. The method of claim 22, wherein:

advancing the plunger comprises moving the plunger from an upper position to a lower position within a plunger passage; and the method further comprises:

providing a flushing channel between the flowbore and the plunger passage; and flowing a flushing fluid down the flowbore, through the plunger passage and through the ball holding area back into the flowbore.

25. The method of claim 24, wherein the step of flowing a flushing fluid comprises placing the plunger in the lower position.

* * * * *